United States Patent [19]

Katzmann et al.

[11] Patent Number: 4,753,172

[45] Date of Patent: Jun. 28, 1988

[54] KINETIC ENERGY SABOT PROJECTILE

[75] Inventors: Harald Katzmann, Neuenhof; David Ammann, Gossau; Pierre H. Freymond, Effretikon, all of Switzerland; Hanspeter Sigg, Jestetten, Fed. Rep. of Germany

[73] Assignee: Werkzeugmaschinenfabrik Oerlikon-Bührle AG, Zürich, Switzerland

[21] Appl. No.: 26,152

[22] Filed: Mar. 16, 1987

[30] Foreign Application Priority Data

Mar. 21, 1986 [CH] Switzerland ..... 01153/86

[51] Int. Cl.[4] ..... F42B 11/14

[52] U.S. Cl. ..... 102/517; 102/491; 102/519

[58] Field of Search ..... 102/491–496, 102/501, 514–519, 529

[56] References Cited

U.S. PATENT DOCUMENTS

| | | | |
|---|---|---|---|
| 3,338,167 | 8/1967 | Jungermann et al. . | |
| 3,566,794 | 3/1971 | Pearson et al. | 102/493 |
| 3,898,933 | 8/1975 | Castera et al. | 102/529 |
| 4,068,590 | 1/1978 | Pearson | 102/493 |
| 4,353,305 | 12/1982 | Moreau et al. | 102/519 |

FOREIGN PATENT DOCUMENTS

| | | |
|---|---|---|
| 146745 | 11/1984 | European Pat. Off. . |
| 0156948 | 10/1985 | European Pat. Off. . |
| 2202275 | 5/1974 | France . |

*Primary Examiner*—Harold J. Tudor
*Attorney, Agent, or Firm*—Werner W. Kleeman

[57] ABSTRACT

The projectiles possess high kinetic energy owing to the high velocity of the projectiles, on the one hand, and the high specific weight of the projectiles, on the other hand. The heretofore normally employed explosive and incendiary charges are replaced by an inert powder serving as the projectile filling or filler and having a density of at least 10 g/cm$^3$ and whose constituents have a mass of $10^{-4}$ to $10^{-2}$ grams. Certain constructions of the projectiles contain a fragmentation jacket, the filling or filler, a closure body or penetrator and a projectile tip. Another construction of the projectile contains a fragmentation jacket, the filling or filler, an integrated base for the fragmentation jacket and the projectile tip.

6 Claims, 1 Drawing Sheet

KINETIC ENERGY SABOT PROJECTILE

BACKGROUND OF THE INVENTION

The present invention relates to a new and improved construction of a kinetic energy sabot projectile activated by or effective by virtue of the action of its kinetic energy.

In its more specific aspects, the present invention relates to a new and improved construction of a kinetic energy sabot projectile suitable for use against various types of targets, particularly homogeneous and heterogeneous targets. The sabot projectile of the present development is of the type comprising a projectile tip and a hollow fragmentation or disintegration jacket which is closed at the rear or rear end and at the front or front end. The projectile tip is attached to or carried by the front or front end of the hollow fragmentation jacket. An inert filling or filler with a density of at least 10 g/cm$^3$ is located in the interior of the hollow fragmentation jacket. The projectile tip protects the fragmentation jacket against premature fragmentation or disintegration. The fragmentation jacket fragments or disintegrates after penetration of the projectile at the target. The filling or filler increases the radial effect of the projectile in the target.

With an undercalibrated or sub-caliber, stabilized multi-purpose projectile of this type, as known from European patent No. 146,745, there is likewise provided a fragmentation jacket with an inert filling or filler. This projectile fragments without the need for using a complicated fuze after target impact of the projectile, during the penetration of the projectile into the target, and possesses a radial effect. The projectile exhibits a projectile body provided with an axial channel which is closed at the front by a ballistic hood. Behind the ballistic hood there is located a piston which is guided in the axial channel of the projectile body in an axially displaceable or slidable manner.

With another projectile of this type activated by kinetic energy, as known from U.S. Pat. No. 4,353,305, granted Dec. 12, 1982, a penetration tip is located at the front and a main penetration body or main penetrator at the rear and intermediate these components there is positioned a spacer sleeve. Pellets are located in this spacer sleeve as secondary or sub-projectiles. These pellets can be flung or propelled away in all directions either by the impact of the projectile in the target or by the action of an explosive or incendiary charge. The spacer sleeve serves as a shock absorber in order to maintain the reflected waves away from the main penetration body which arise during the impact of the projectile at the target. The secondary or sub-projectiles are preferably made from heavy metal.

Now it has been found that these known projectiles do not yet attain the desired synergistic effect and can be further improved in their operation.

SUMMARY OF THE INVENTION

Therefore, with the foregoing in mind, it is a primary object of the present invention to provide a new and improved construction of a kinetic energy sabot projectile which does not exhibit the aforementioned drawbacks and shortcomings of the prior art constructions.

Another and more specific object of the present invention aims at the provision of a new and improved construction of a projectile which is particularly suitable for combatting various types of targets and which, on penetrating several plates of a target, effects as great as possible destruction of the target in the radial direction.

Now in order to implement these and still further objects of the invention, which will become more readily apparent as the description proceeds, the sabot projectile of the present invention is manifested by the feature that the filling or filler comprises a powder whose granule or grain size is smaller than 200 $\mu$m.

Preferably the fragmentation or disintegration jacket possesses an integrated base at its rear end and its hollow space is closeable at the front by a projectile tip, or the fragmentation or disintegration jacket possesses an integrated projectile tip at the front and can be closed at the rear by a closure body or closure.

The fragmentation jacket is preferably provided with reference fracture locations, by means of which the size of the individual fragments or splinters is determined. Instead of a construction using reference fracture locations, the fragmentation jacket can be designed to be so brittle that it fragments or disintegrates into individual fragments on penetrating into the target.

The invention is particularly suitable for medium caliber multi-purpose projectiles (i.e. 20–40 mm caliber) for combatting airborne targets.

The projectiles preferably should be exclusively made of metallic materials, especially heavy metal. In order to achieve a high cross-sectional loading there is dispensed with the use of an explosive, an incendiary charge and a fuze. Nevertheless, fragmentation and explosive effects should not be foregone, and a large depth of penetration of the projectile is desired.

The projectile should possess a high probability of striking or hitting the intended target, which is achieved by means of a short flight time. To achieve a short flight time, a high cross-sectional mass loading is necessary, in order to keep the deceleration or retardation of the projectile by the air resistance small. A high cross-sectional mass loading is attained by the use of high density materials.

Furthermore, a high initial velocity is achieved by the use of a sabot.

The projectile should possess a great destructive capacity or effect, which is attained when as much as possible of the total kinetic energy is transferred from the projectile to the target, in order to be able to destroy a great volume of the target. However, for this effect to be realized it is necessary that the projectile only fragments after penetrating into the target and not already on impact. The radial action of the projectile may therefore only take place after a certain time-delay. Armor plating and other target coverings or shielding should be penetrated with as little energy expenditure as possible.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
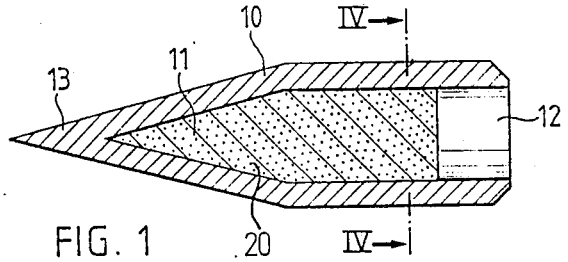
FIG. 1 illustrates a longitudinal section through a first exemplary embodiment of the inventive projectile.

Describing now the drawings, it is to be understood that to simplify the showing thereof, only enough of the construction of the various exemplary embodiments of kinetic energy sabot projectile has been illustrated therein as needed to enable one skilled in the art to readily understand the underlying principles and concepts of the present invention. Turning now to specifically to FIG. 1 of the drawing, the first embodiment of kinetic energy projectile illustrated therein by way of example and not limitation, will be seen to comprise a hollow fragmentation or disintegration jacket or shell 10, a filling or filler 11 in the hollow space 20 thereof, a closure body or closure 12 and an integrated projectile tip 13 for the fragmentation jacket or shell 10.

Figure 2:
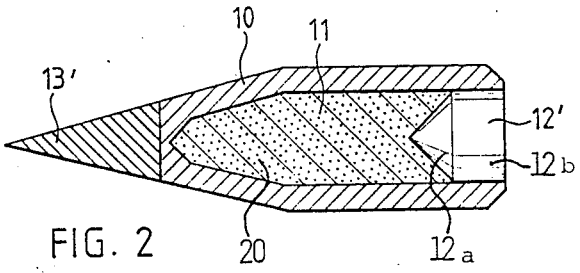
FIG. 2 illustrates a longitudinal section through a second exemplary embodiment of the inventive projectile.

In the second exemplary embodiment depicted in FIG. 2, the inventive kinetic energy projectile possesses a penetrator 12' instead of the closure body or closure 12 of the embodiment of FIG. 1 and instead of the integrated projectile tip 13 thereof a separate projectile tip 13'.

Figure 3:
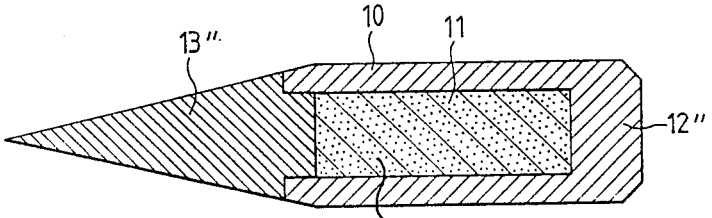
FIG. 3 illustrates a longitudinal section through a third exemplary embodiment of the inventive projectile.

In the third exemplary embodiment depicted in FIG. 3, the inventive projectile possesses neither a closure body 12 nor a penetrator 12' at the rear end, but an integrated base 12'' and a projectile tip 13'' constructed as a closure body is provided instead of the integrated projectile tip 13 or separate projectile tip 13'.

Figure 4:
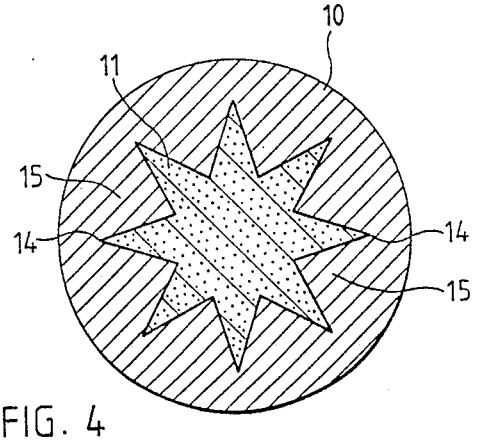
FIG. 4 illustrates a section taken substantially along line IV—IV of FIG. 1 on an enlarged scale as compared to FIGS. 1 to 3.

The hollow fragmentation jacket 10 will fragment after the penetration of the projectile into the target and will fragment or disintegrate into individually effective fragments or splinters or the like. An appropriate heavy metal alloy is used for this hollow fragmentation jacket 10, for example, tungsten or uranium. Sintered heavy metal, steel or hard metal or metal carbide is also suitable. The fragmentation jacket 10 should either be very brittle or it should fragment or disintegrate at reference fracture locations 14 into fragments 15 of appropriate size (see FIG. 4). Preferably a material is used whose elongation or extensibility is below about 10%.

The powdery filling or filler 11 is dispersed or expelled in all directions after the penetration of the projectile into the target. A heavy metal powder is used for this filling or filler 11, particularly tungsten powder, that has a high density of 10 g/cm$^3$ and a granule or grain size of about 10 to 200 μm, i.e the granule or grain size should be smaller than 200 μm. Heavy metal powder is preferably used for the filling or filler 11. The dispersal or spreading apart of the filling or filler 11 in the target causes a pressure wave.

The closure body 12, particularly the penetrator 12', fulfills the task of penetrating as deep as possible into the target without breaking apart or splitting up. A heavy metal alloy, possessing however a high toughness and which can penetrate armor plating, is also preferred for the closure body 12 or penetrator 12'.

The closure body or element 12 is substantially cylindrical in shape (FIG. 1). The penetrator 12' possesses a tapered portion or conical tip **12*a* at the front of its substantially cylindrical body portion 12*b*** (FIG. 2).

When the projectile penetrates the target, the projectile tip 13, 13' or 13'', as the case may be, should prevent a premature fragmentation or splitting up of the fragmentation jacket 10 and a premature dispersal of the filling or filler 11. A tough and hard material is used for the projectile tip. As depicted in FIG. 1, the projectile tip 13 can be made of one piece with the fragmentation jacket 10.

The mode of operation of the projectile described hereinbefore is as follows:

The elements of the projectile, particularly the fragmentation jacket 10, filling or filler 11 and closure body 12, penetrator 12' and integrated base 12'', as the case may be, are matched or coordinated to one another such that a high synergism in the target is attained. The fragmentation jacket 10 and closure body 12, penetrator 12' and integrated base 12'', as the case may be, guarantee the necessary structural stability of the projectile during introduction to or loading into the firing weapon and during the projectile firing phase.

The elements have a variable effect in the target, as they possess various dimensions:

(a) The closure body 12, penetrator 12' and integrated base 12'', as the case may be, each exhibits a mass of 10–100 grams. With these components 12, 12' and 12'' only a few holes are produced deep in the target.

(b) The fragments of the fragmentation jacket 10 exhibit a mass of 0.1 to 10 grams. With the fragments, many individual holes are produced.

(c) The powder granules or grains of the filling or filler 11 have a mass of 0.0001 to 0.01 gram. A heterogeneous target is destroyed with this filling or filler 11.

However, the action of these elements is graded. The radial action of the projectile is increased by the projectile spin; therefore the relationship between kinetic energy in the firing direction and kinetic spin energy is important.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. A kinetic energy sabot projectile suitable for combatting various types of targets, particularly homogeneous and heterogeneous targets, comprising:

a projectile tip;

a hollow fragmentation jacket having a closed rear end and a closed front end and defining an interior space therebetween;

said projectile tip being carried at the front end of the hollow fragmentation jacket;

an inert filler with a density of at least 10 grams/cm$^3$ located in the interior space extending between said closed rear end and said closed front end of said hollow fragmentation jacket;

said projectile tip being made of a tough and hard material for protecting said fragmentation jacket against premature fragmentation;

said fragmentation jacket fragmenting after penetration into the target;

said filler increasing the radial effect in the target; and said filler comprising a powder having a grain size which is smaller than 200 μm.

2. The kinetic energy sabot projectile as defined in claim 1, wherein:

said hollow fragmentation jacket possesses an integrated base at its rear end for closing said rear end;

said hollow fragmentation jacket possessing internally thereof a hollow space having a front end; and said projectile tip closing said front end of said hollow space of said hollow fragmentation jacket.

3. The kinetic energy sabot projectile as defined in claim 1, wherein:

said projectile tip comprises an integrated projectile tip which is integrated with the front end of the hollow fragmentation jacket; and a closure body for closing the rear end of the hollow fragmention jacket.

4. The kinetic energy sabot projectile as defined in claim 1, wherein:

said hollow fragmentation jacket is provided with reference fracture locations for determining the size of individual fragments produced from said hollow fragmentation jacket upon penetrating the target.

5. The kinetic energy sabot projectile as defined in claim 1, wherein:

said fragmentation jacket being made of a brittle material having an elongation at rupture less than 10 percent such that the fragmentation jacket fragments into individual fragments on penetrating the target.

6. The kinetic energy sabot projectile as defined in claim 1, wherein:

said hollow fragmentation jacket is provided with reference fracture locations for determining the size of individual fragments produced from said hollow fragmentation jacket upon penetrating the target; and said fragmentation jacket possessing a brittleness such that it fragments into individual fragments on penetrating the target.

* * * * *